US006435864B2

(12) United States Patent
Slade et al.

(10) Patent No.: US 6,435,864 B2
(45) **Date of Patent: *Aug. 20, 2002**

(54) DOOR ASSEMBLY FOR ROTARY FURNACE

(75) Inventors: Richard S. Slade, Spokane, WA (US); Robert J. Garrett, Rathdrum, ID (US); David P. LaVelle, Spokane, WA (US); Lee Newton, Colleyville; Joseph Wojciechowski, Carrollton, both of TX (US)

(73) Assignee: Imco Recycling, Inc., Irving, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/770,025

(22) Filed: Jan. 25, 2001

Related U.S. Application Data

(63) Continuation of application No. 09/558,696, filed on Apr. 25, 2000, now Pat. No. 6,213,763.

(51) Int. Cl.[7] ..... F27B 7/00

(52) U.S. Cl. ..... 432/103; 432/104; 432/250

(58) Field of Search ..... 432/103, 104, 432/114, 250; 110/246

(56) References Cited

U.S. PATENT DOCUMENTS 6,213,763 B1 * 4/2001 Slade et al. ..... 432/103

* cited by examiner

*Primary Examiner*—Jiping Lu
(74) *Attorney, Agent, or Firm*—Michael A. O'Neil

(57) ABSTRACT

A rotary furnace includes a drum and a frame supporting the frame for rotation about a nominally horizontal rotational axis. The frame and the drum are supported for pivotal movement about a horizontal pivotal axis. A door supported on the frame normally closes the front end of the drum and is selectively pivotal to an open position to facilitate charging of the drum. The door includes a pouring door which is openable to facilitate discharge of molten material from the drum.

17 Claims, 9 Drawing Sheets

DOOR ASSEMBLY FOR ROTARY FURNACE

This application is a continuation of Ser. No. 09/558,696 filed Apr. 25, 2000 U.S. Pat. No. 6,213,763.

TECHNICAL FIELD

This invention relates generally to rotary furnaces of the type utilized in the recycling of aluminum, and more particularly to an improved door construction useful in conjunction with rotary furnaces to enhance the efficiency thereof.

BACKGROUND AND SUMMARY OF THE INVENTION

The recycling of aluminum frequently involves the use of rotary furnaces. Typically, aluminum scrap and/or used aluminum products are received in a rotary furnace for melting. When melting is complete, the molten aluminum is discharged from the rotary furnace for further processing.

More specifically, rotary furnaces of the type utilized in aluminum recycling comprise a large drum which is supported for rotation about a longitudinal axis. One end of the drum is closed with the other end of the drum being normally closed by a door. At the start of each operating cycle, the drum is tilted upwardly for charging with aluminum to be melted. The drum is tilted downwardly into a horizontal orientation and the door is closed. The temperature within the drum is then raised sufficiently to melt the aluminum received therein. After the aluminum is melted, the drum is tilted downwardly to discharge the aluminum for further processing.

Heretofore, the doors used to close rotary furnaces during the melting of aluminum received therein have been supported independently from the drum of the furnace. This means that the door must be fully opened both during the charging of the drum with aluminum to be melted and during the discharge of the aluminum from the drum. The requirement of fully opening the drum to effect discharge of molten aluminum therefrom is disadvantageous because it allows the drum to cool thereby requiring substantial reheating for the next operating cycle.

The present invention comprises an improvement during construction for rotary furnaces which overcomes the foregoing and other difficulties which have long characterized the prior art. In accordance with the broader aspects of the invention, a rotary furnace is provided with a door which is supported for pivotal movement with the drum between its upwardly inclined charging orientation, its horizontal melting orientation, and its downwardly inclined discharging orientation. Because the door pivots with the drum, it is not necessary to fully open the door in order to discharge molten aluminum therefrom. Rather, the lower portion of the door is separately openable to permit discharging of molten aluminum, thereby retaining heat within the drum.

In accordance with more specific aspects of the invention, a rotary furnace includes a drum that is supported on a frame for pivotal movement between an upwardly inclined charging orientation, a horizontal melting orientation, and a downwardly inclined discharge orientation. A door for the drum is mounted on the same frame as the drum for pivotal movement therewith. The door is fully openable to facilitate charging of the drum with aluminum to be melted. The door includes a pour door comprising the lower portion thereof which is separately openable to facilitate the discharge of molten aluminum from the drum.

The door of the present invention further includes apparatus for heating the interior of the drum to melt the aluminum contained therein. Typically, the heating apparatus comprises a burner fueled by natural gas, however, other heating apparatus may be utilized in the practice of the invention. The heating apparatus is operated not only during the melting of the aluminum received in the drum, but also during the discharge of molten aluminum from the drum so that the interior of the drum is not significantly cooled during the discharging of the aluminum. In this manner the operational efficiency of rotary furnaces incorporating the door of the present invention is substantially increased.

BRIEF DESCRIPTION OF THE DRAWINGS

A more complete understanding of the invention may be had by reference to the following Detailed Description when taken in conjunction with the accompanying Drawings, wherein.

DETAILED DESCRIPTION

Figure 1:
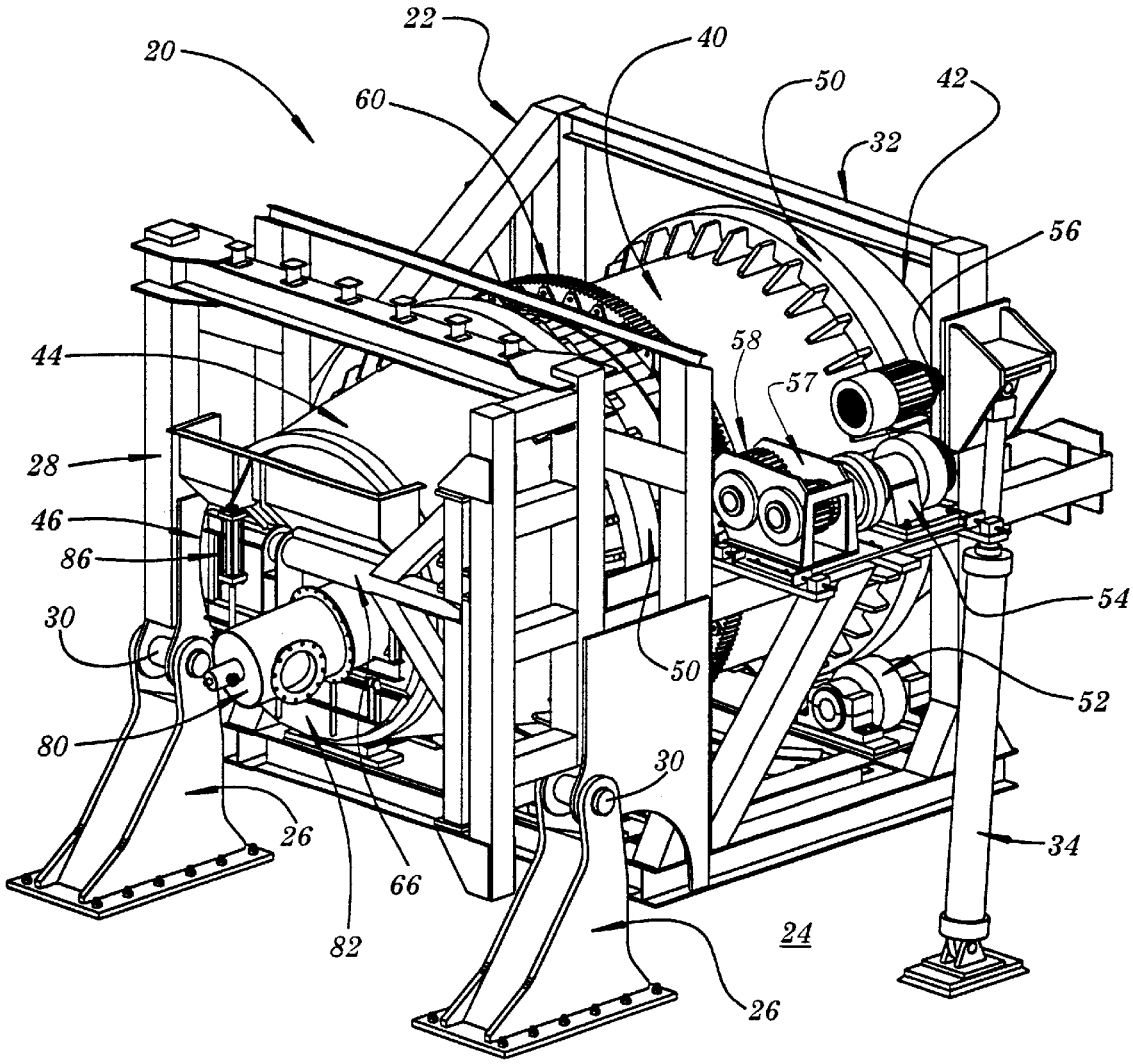
FIG. 1 is a perspective view of a rotary furnace incorporating a door comprising the present invention and illustrating the door in its closed position.
Figure 2:
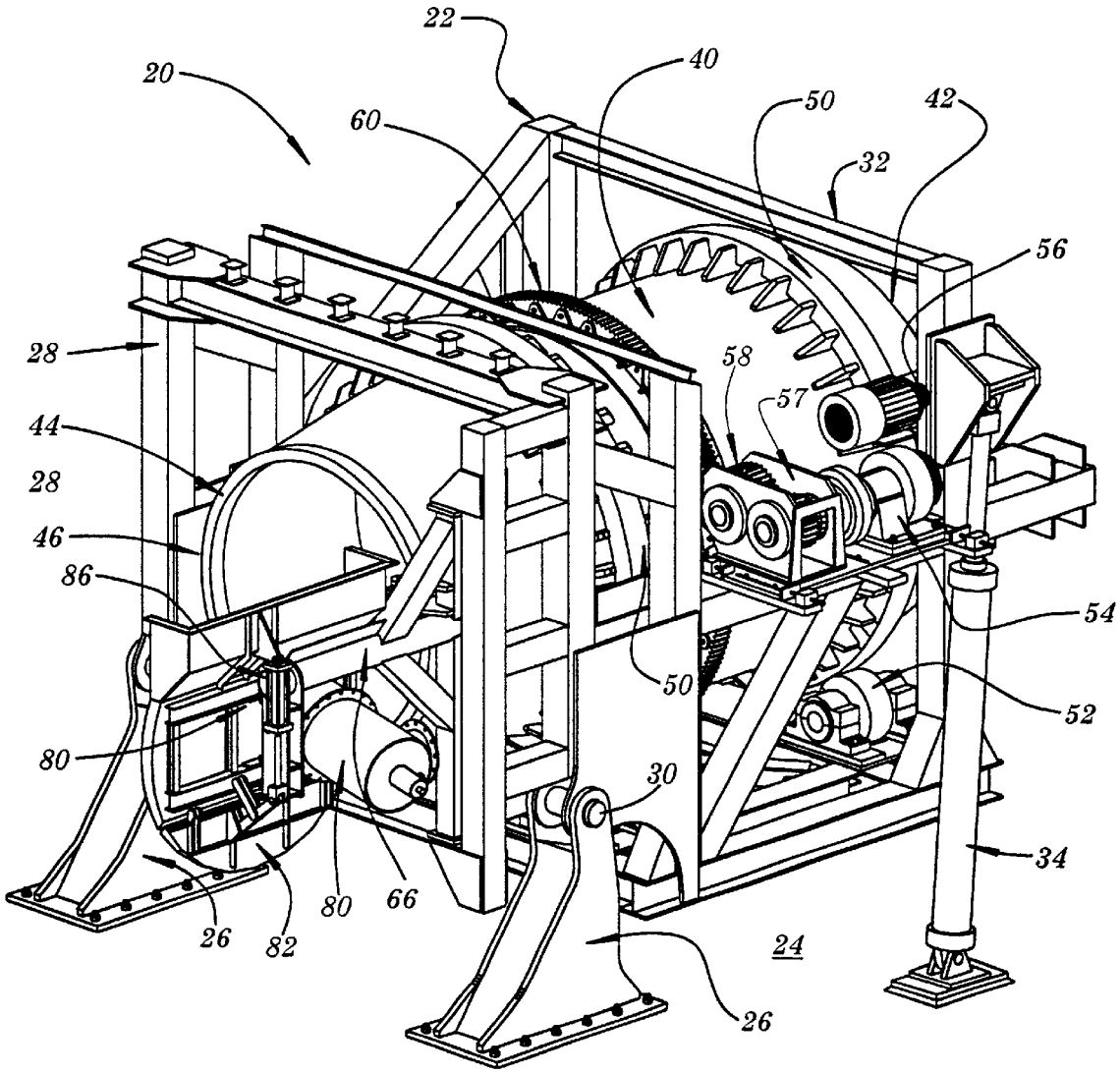
FIG. 2 is an illustration similar to FIG. 1 showing the door of the rotary furnace in its open position.

Referring now to the Drawings, and particularly to FIGS. 1 and 2 thereof, there is shown a rotary furnace 20 incorporating the present invention. The rotary furnace 20 includes a frame 22 which is supported on an underlying surface 24. A pair of support members 26 support the forward end 28 of the frame 22 on trunnions 30. The rearward end 32 of the frame 22 is supported by fluid powered cylinders 34 which are selectively extendable and retractable to pivot the frame 22 and the components carried thereby relative to the underlying surface 24 about a horizontal axis defined by the trunnions 30.

The rotary furnace 20 further includes a drum 40 which receives aluminum and/or other materials for melting. The rearward end 42 of the drum 40 is closed. The forward end 44 of the drum 40 is normally closed by a door 46. FIG. 1 illustrates the door 46 in its closed position, and FIG. 2 illustrates the door 46 in its opened position.

The drum 40 is provided with a pair of bearing rings 50. Bearing assemblies 52 mounted on the frame 22 engage the bearing rings 50 to support the drum 40 for rotation about a nominally horizontal axis extending perpendicularly to the axis defined by the trunnions 30. The drum 40 is rotated about its axis by a drive mechanism 54 including a drive motor 56 and a pinion 58 which is mounted in mesh with a ring gear 60 mounted on the drum 40.

Figure 3:
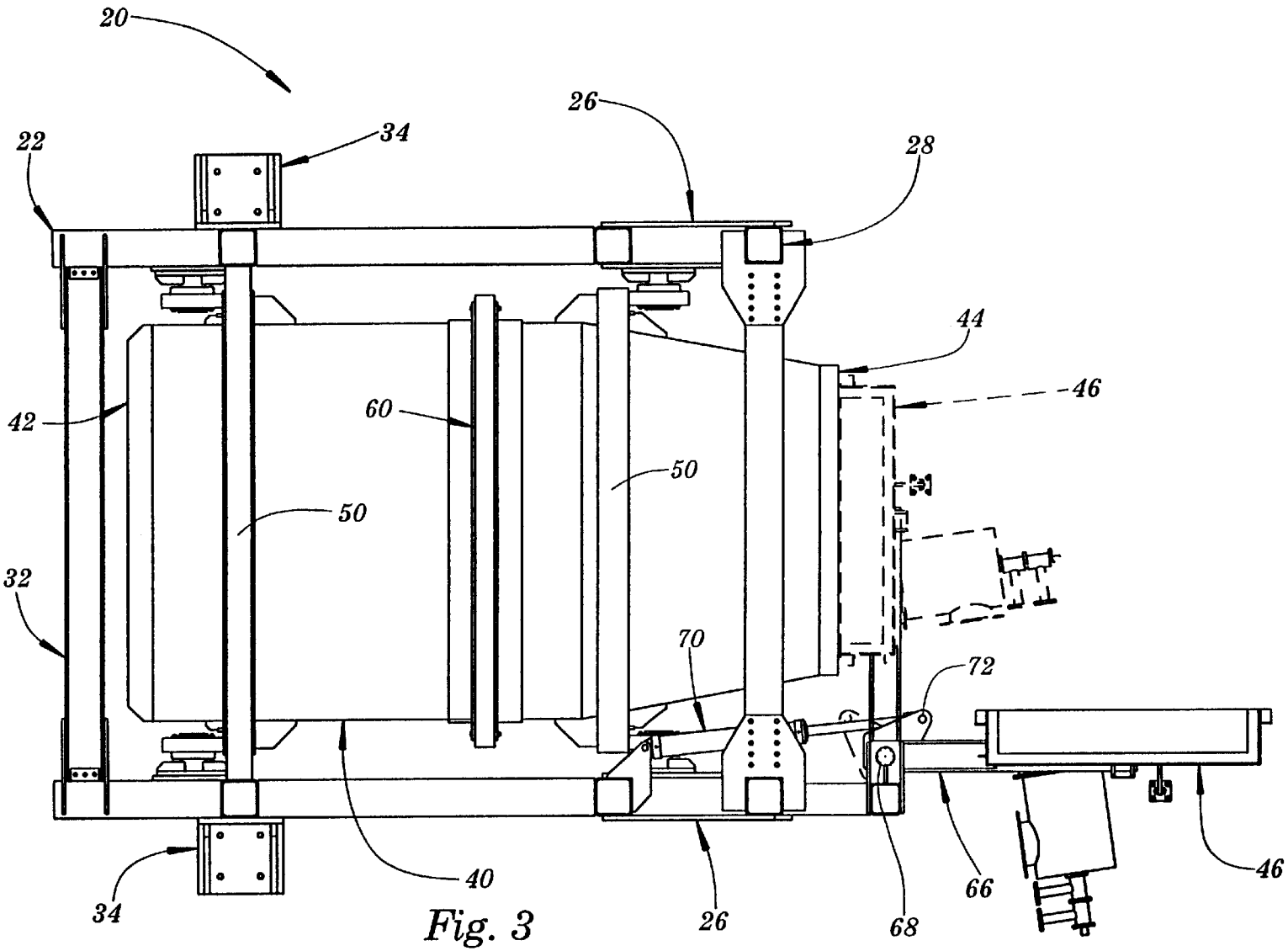
FIG. 3 is a bottom view of the rotary furnace of FIG. 1 further illustrating the open and closed positions of the door of the present invention.

The relationship of the door 46 to the drum 40 is further illustrated in FIG. 3 wherein the door 46 is shown in its closed position in dashed lines and in its open position in full lines. The door 46 includes a swing arm 66 which supports the door 46 for pivotal movement relative to the frame 22 about a nominally vertically disposed axis 68 extending perpendicularly to the axis of rotation of the drum 40 and to the axis of pivotal movement of the drum 40 as defined by the trunnions 30. The door 46 is pivoted between its opened and closed positions by a fluid powered cylinder 70 which extends between the frame 22 and a bell crank 72 mounted on the swing arm 66.

The door 46 of the rotary furnace 20 is further illustrated in FIGS. 4, 5, 6, and 7. The door 46 supports a heating apparatus 80 which supplies the heat necessary to melt the aluminum and/or other material contained within the drum 40. The heating apparatus 80 may comprise a North American ATP (adaptive thermal profile) low NOx natural gas combustion air burner, designation 4484-14. Other types and kinds of heating apparatus may be utilized in the practice of the invention depending upon the requirements of particular applications thereof.

Figure 4:
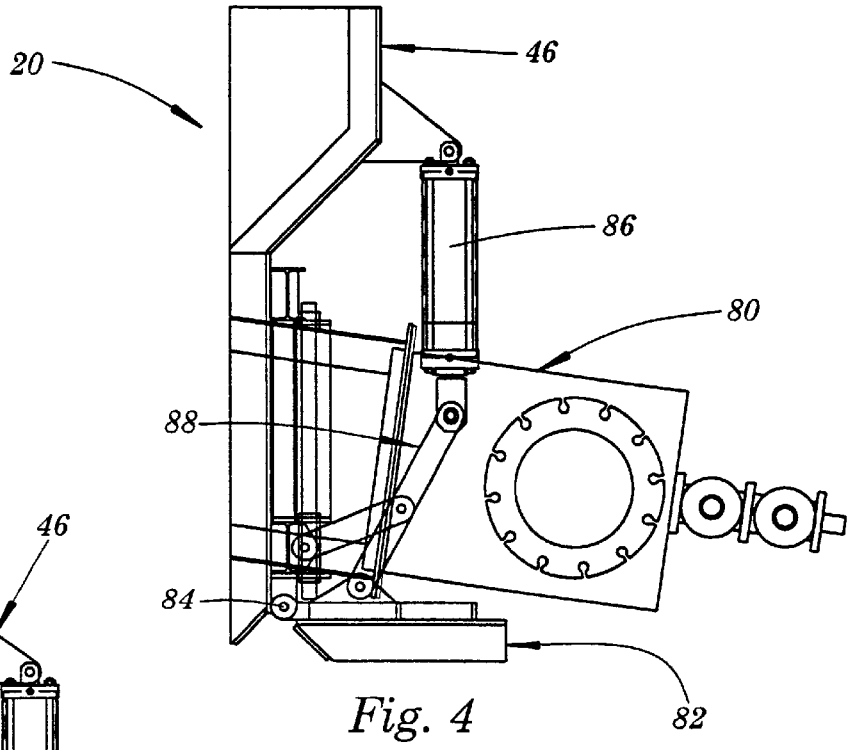
FIG. 4 is a side view of the door of the present invention illustrating the construction and operation of the pouring door component thereof.
Figure 5:
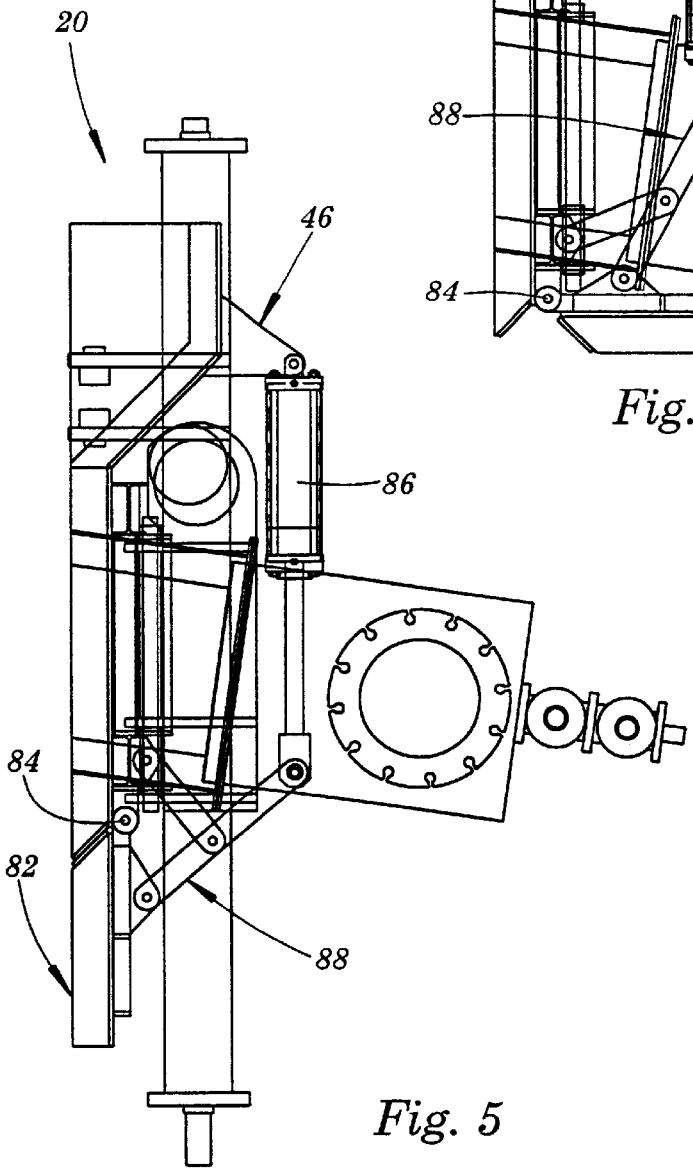
FIG. 5 is a view similar to FIG. 4 further illustrating the construction and operation of the pouring door.
Figure 6:
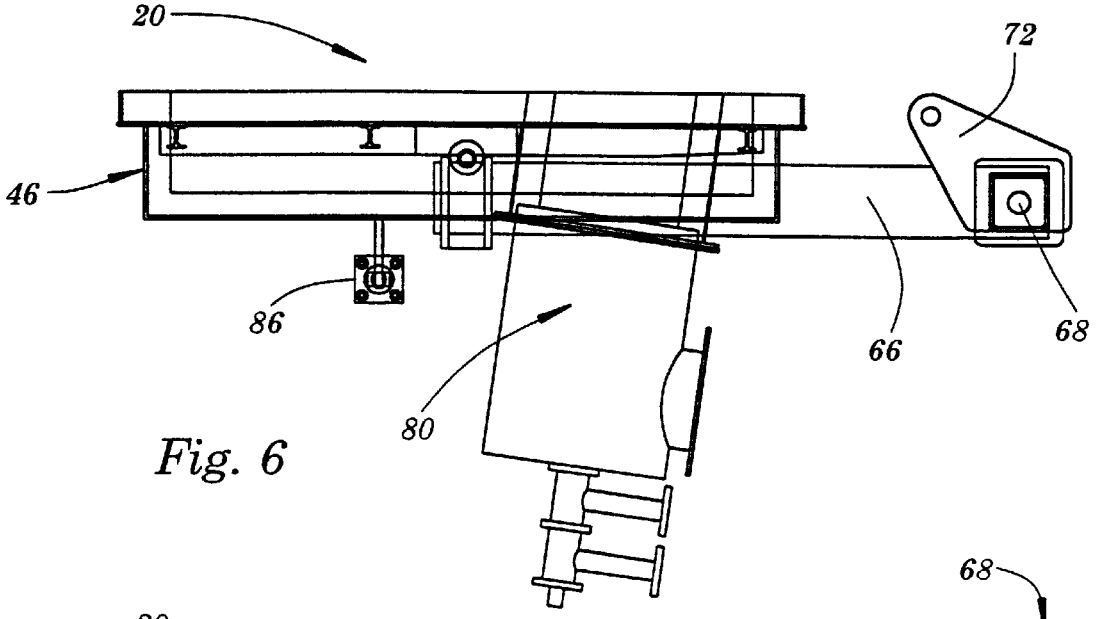
FIG. 6 is a top view of the rotary furnace door of the present invention.
Figure 7:
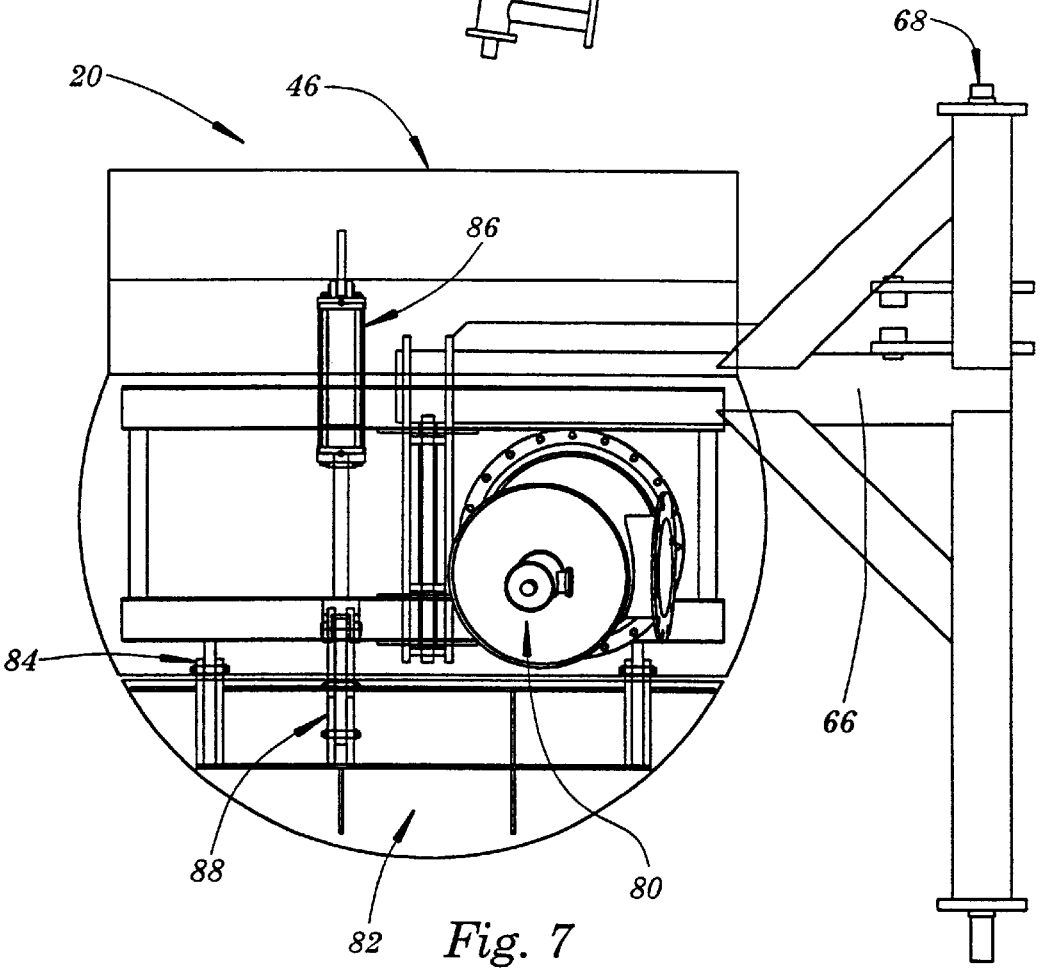
FIG. 7 is a front view of the rotary furnace door of the present invention.

The lower portion of the door 46 comprises a pouring door 82 which is illustrated in its open position in FIG. 4 and in its closed position in FIG. 5. The pouring door 82 is supported for pivotal movement about a nominally horizontal axis 84 between the positions illustrated in FIG. 4 and FIG. 5. The pouring door 82 is actuated by a fluid powered cylinder 86 which operates the pouring door 82 through a linkage 88.

Figure 8:
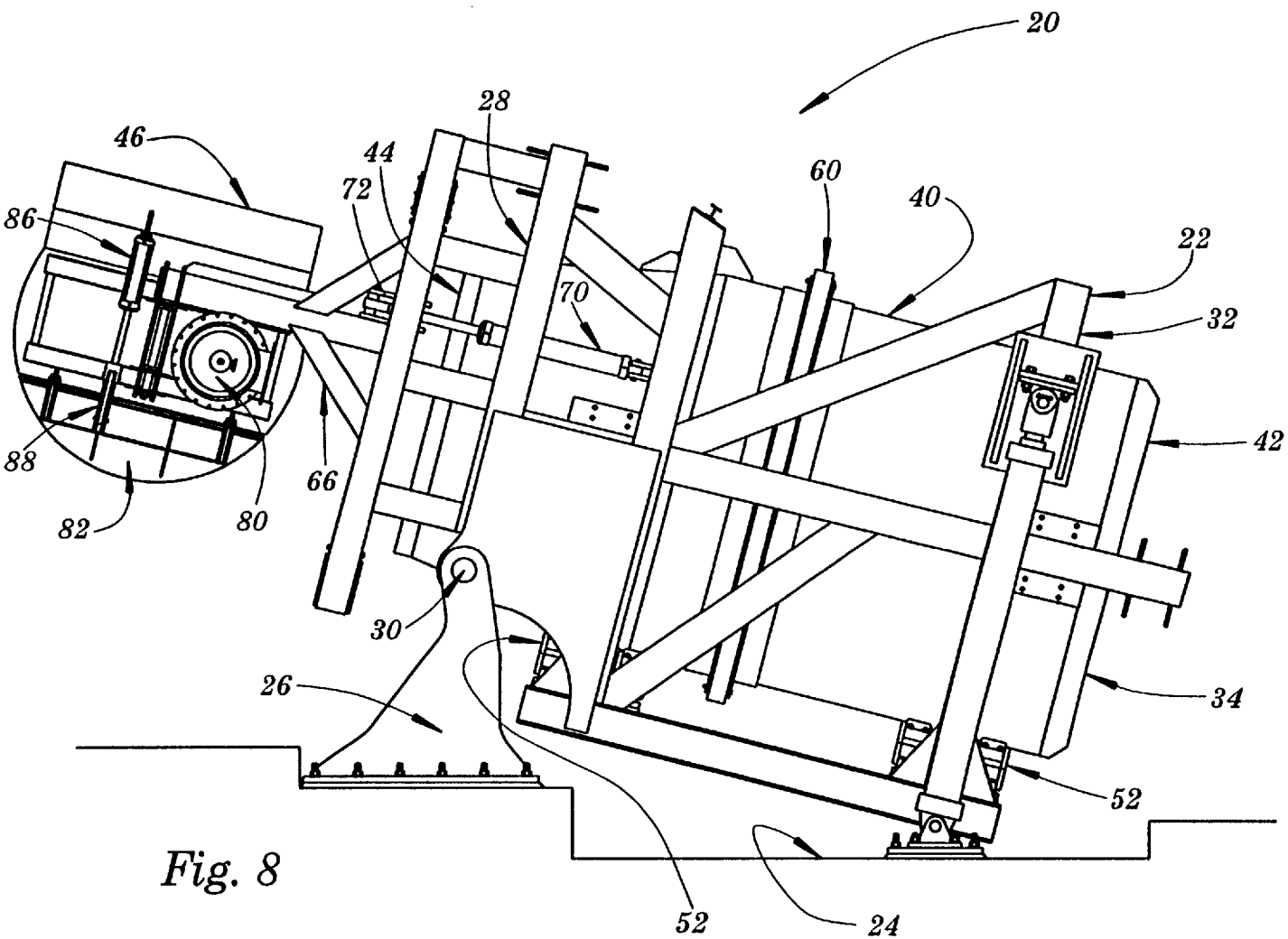
FIG. 8 is a side view of a rotary furnace incorporating the door of the present invention showing the furnace in its upwardly inclined charging orientation.
Figure 9:
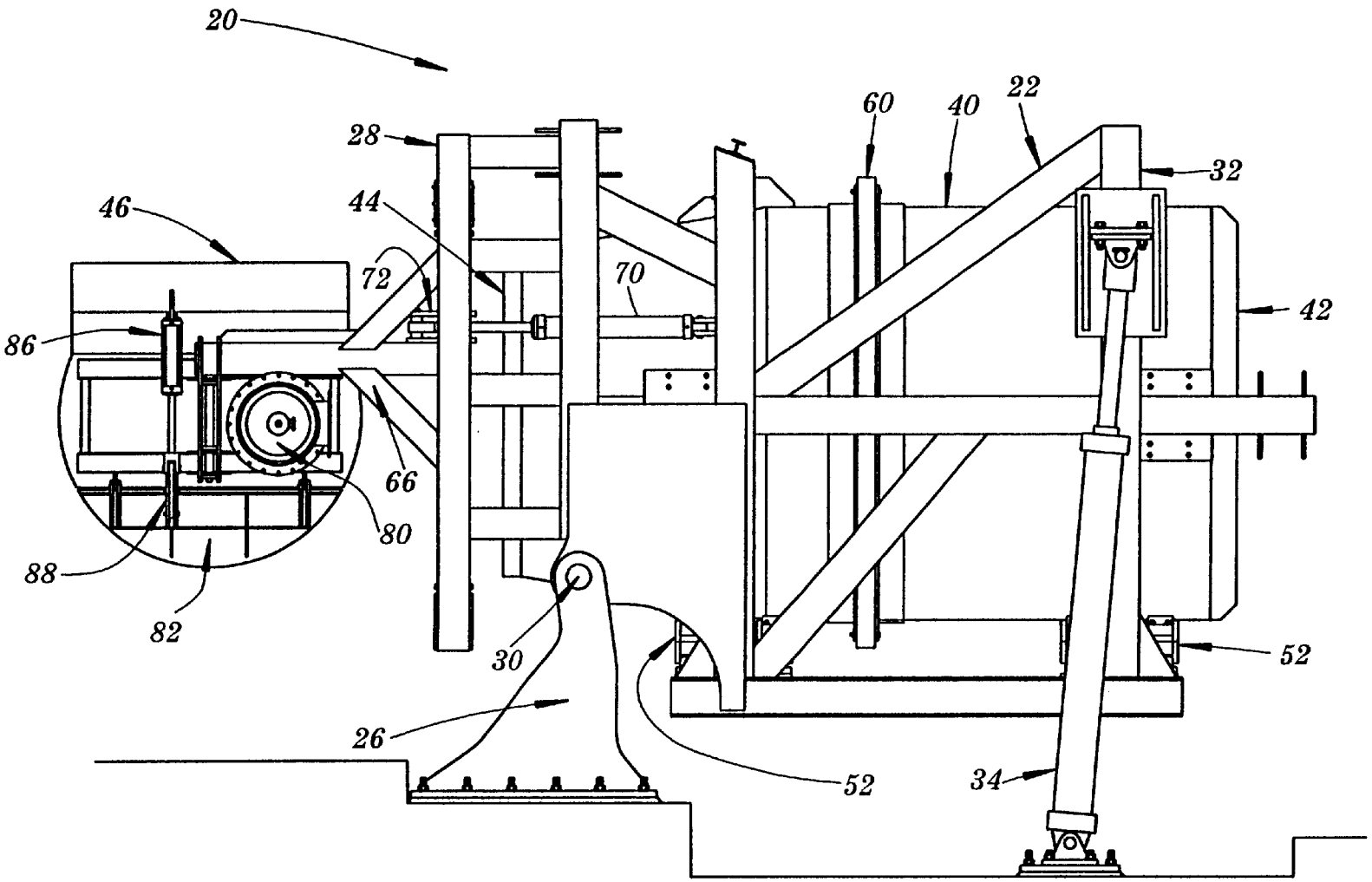
FIG. 9 is an illustration of a rotary furnace incorporating the door of the present invention showing the rotary furnace in its horizontally disposed melting orientation.
Figure 9A:
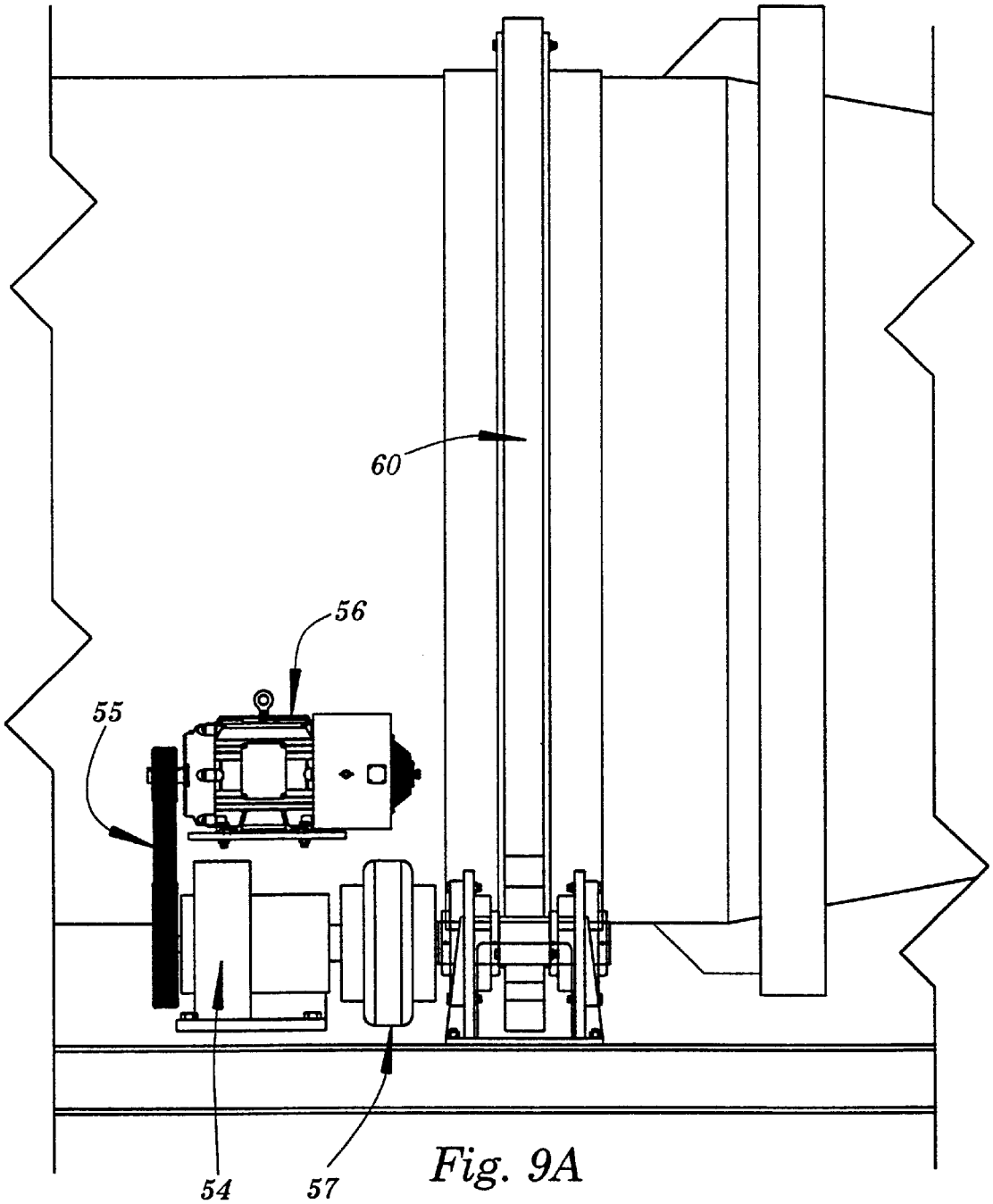
Figure 10:
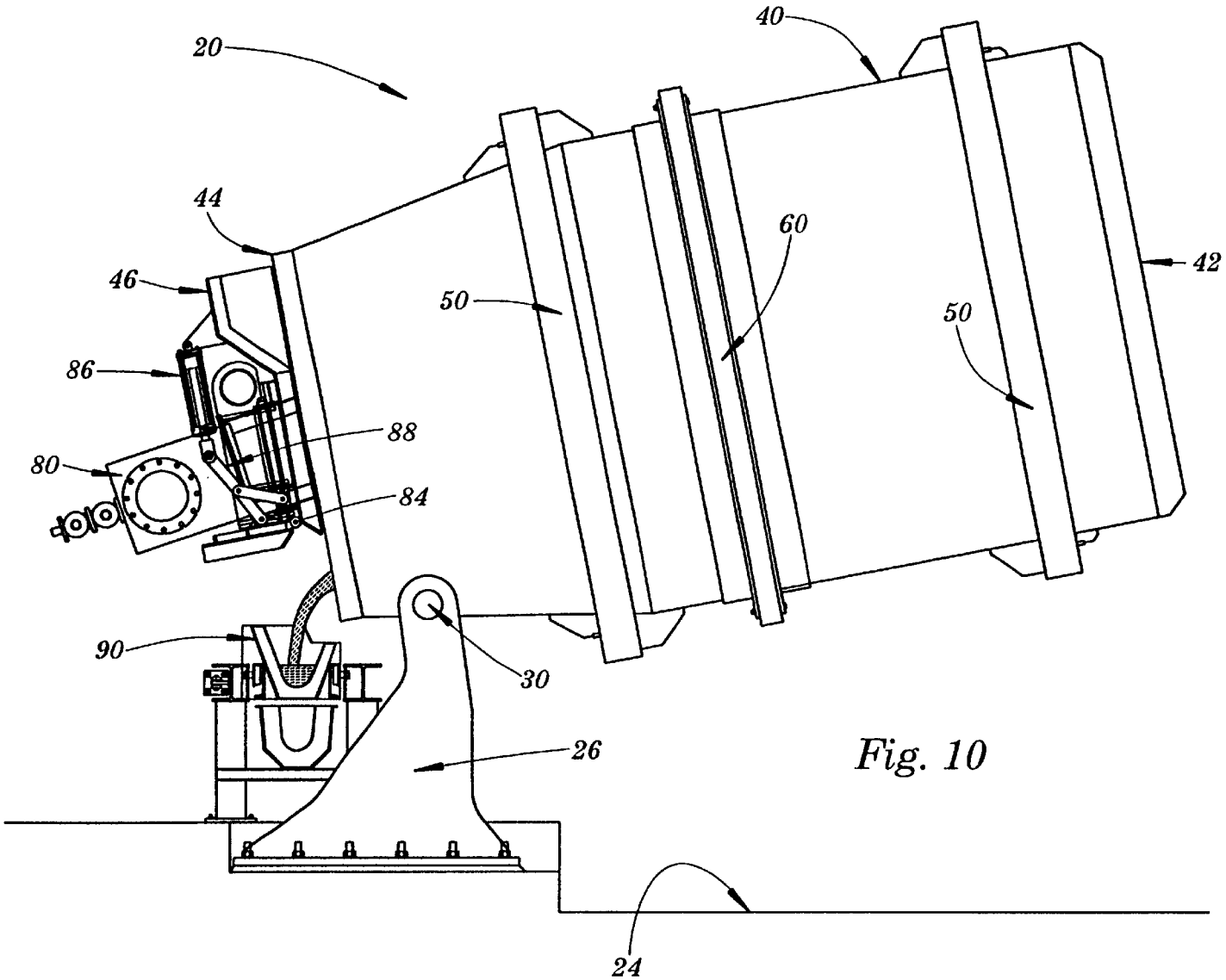
FIG. 10 is an illustration of the rotary furnace of FIGS. 8 and 9 showing the rotary furnace in its downwardly disposed discharging orientation and illustrating the pouring door of the door of the present invention in its open configuration.

The operation of the rotary furnace 20, and in particular the door 46 thereof, is illustrated in FIGS. 8, 9, and 10. In FIG. 8, the drum 40 of the rotary furnace 20 is pivoted upwardly under the action of the fluid powered cylinders 34. The door 46 is pivoted to its open position under the action of the fluid powered cylinder 70. The forward end 44 of the drum 40 is thereby fully opened for charging with aluminum and/or other materials to be melted.

In FIG. 9, the axis of rotation of the drum 40 extends horizontally. The fluid powered cylinder 70 is actuated to close the door 46. The drive mechanism 54 is actuated to rotate the drum 40 about its rotational axis, and the heating apparatus 80 is operated to heat the interior of the drum 40, thereby melting the contents thereof.

After the contents of the drum are melted, the fluid powered cylinders 34 are actuated to pivot the drum 40 into the orientation illustrated in FIG. 10. The fluid powered cylinder 86 is actuated to open the pouring door 82, whereupon molten metal MM is discharged from the drum 40 into a suitable receiving vessel 90.

During discharge of the molten metal MM from the interior of the drum 40 through the now open pouring door 82, the door 46 remains closed. During the discharge of the molten metal MM into the vessel 90, the heating apparatus 80 is operated at a low level. Because the door 46 remains closed and the operation of the heating apparatus 80 is continued, the interior of the drum 40 remains hot during the discharge of molten metal therefrom. In this manner, substantial cost savings are achieved since it is not necessary to reheat the interior of the drum 40 when the next charge of material to be melted is received therein.

Although preferred embodiments of the invention have been illustrated in the accompanying Drawings and described in the foregoing Detailed Description, it will be understood that the invention is not limited to the embodiments disclosed, but is capable of numerous rearrangements, modifications, and substitutions of parts and elements without departing from the spirit of the invention.

What is claimed is:

1. In a rotary furnace of the type including a frame, a drum for receiving material to be melted, bearings supporting the drum on the frame for rotation about a nominally horizontal axis, support members supporting the frame and the drum for pivotal movement about a horizontal axis extending perpendicularly to the rotational axis of the drum, a door for normally closing the front end of the drum, support structure supporting the door on the frame for pivotal movement about a nominally vertical axis extending perpendicular to the rotational axis and to the pivotal axis for movement between an open position and a closed position relative to the front end of the drum and heating apparatus mounted on the door for heating the interior of the drum to melt material contained within the drum, the improvement comprising:

a pouring door mounted on the door for selective actuation between open and closed positions to facilitate discharge of molten material from the drum.

2. The improvement according to claim 1 further including at least one fluid powered cylinder for selectively pivoting the frame and the drum about the pivotal axis.

3. The improvement according to claim 1 further including at least one fluid powered cylinder for selectively pivoting the door between its open and closed positions relative to the front end of the drum.

4. The improvement according to claim 1 further including at least one fluid powered cylinder for selectively moving the pouring door between its open and closed positions.

5. The improvement according to claim 1 wherein the heating apparatus is mounted on the door.

6. The improvement according to claim 5 wherein the heating apparatus comprises a burner.

7. The improvement according to claim 1 wherein the door comprises upper and lower portions, and wherein the pouring door comprises the lower portion of the door.

8. The improvement according to claim 7 further including structure supporting the pouring door on the door for pivotal movement about a horizontal axis.

9. A rotary furnace comprising:

a frame;

a drum for receiving material to be melted;

bearings supporting the drum on the frame for rotation about a nominally horizontal axis;

support members supporting the frame and the drum for pivotal movement about a horizontal axis extending perpendicularly to the rotational axis of the drum;

a door for normally closing the front end of the drum;

support structure supporting the door on the frame for pivotal movement about a nominally vertical axis extending perpendicular to the rotational axis and to the pivotal axis for movement between an open position and a closed position relative to the front end of the drum;

heating apparatus mounted on the door for heating the interior of the drum to melt material contained within the drum; and a pouring door mounted on the door for selective actuation between open and closed positions to facilitate discharge of molten material from the drum.

10. The rotary furnace according to claim 9 further including at least one fluid powered cylinder for selectively pivoting the frame and the drum about the pivotal axis.

11. The rotary furnace according to claim 9 further including at least one fluid powered cylinder for selectively pivoting the door between its open and closed positions relative to the front end of the drum.

12. The apparatus according to claim 9 further including at least one fluid powered cylinder for selectively moving the pouring door between its open and closed positions.

13. The rotary furnace according to claim 9 wherein the heating apparatus comprises a burner.

14. The rotary furnace according to claim 9 wherein the door comprises upper and lower portions, and wherein the pouring door comprises the lower portion of the door.

15. The rotary furnace according to claim 9 further including structure supporting the pouring door on the door for pivotal movement about a horizontal axis.

16. The rotary furnace according to claim 9 further including at least one fluid powered cylinder for selectively pivoting the pouring door between its open and closed positions.

17. The rotary furnace according to claim 9 wherein the door comprises upper and lower portions, wherein the pouring door comprises the lower portion of the door, wherein the door includes structure supporting the pouring door for pivotal movement about a horizontal axis, and further including at least one fluid powered cylinder for selectively pivoting the pouring door between its open and closed positions.

* * * * *